US009464635B2

(12) United States Patent
Fournier et al.

(10) Patent No.: US 9,464,635 B2
(45) Date of Patent: Oct. 11, 2016

(54) MECHANICAL COOLANT PUMP

(75) Inventors: Arnaud Fournier, Yutz (FR); Gilles Simon, Montois la Montagne (FR)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 483 days.

(21) Appl. No.: 14/006,320

(22) PCT Filed: Mar. 24, 2011

(86) PCT No.: PCT/EP2011/054566

§ 371 (c)(1),
(2), (4) Date: Nov. 14, 2013

(87) PCT Pub. No.: WO2012/126530

PCT Pub. Date: Sep. 27, 2012

(65) Prior Publication Data

US 2014/0056697 A1 Feb. 27, 2014

(51) Int. Cl.
*F04D 27/00* (2006.01)
*F04D 29/46* (2006.01)

(52) U.S. Cl.
CPC ..... *F04D 27/002* (2013.01); *F04D 29/466* (2013.01)

(58) Field of Classification Search
CPC ..... F04D 27/002; F04D 29/466
See application file for complete search history.

(56) References Cited

U.S. PATENT DOCUMENTS 1,694,481 A * 12/1928 Moody ..... F03B 11/006 415/128
1,771,711 A * 7/1930 Hahn ..... F04D 29/466 415/146
3,756,739 A * 9/1973 Boussuges ..... F03B 3/103 415/161
4,153,385 A * 5/1979 Riefenthaler ..... F04D 29/464 415/148
4,496,282 A * 1/1985 Gokhman ..... F03B 3/103 415/161
4,780,054 A * 10/1988 Yano ..... F01D 17/165 415/150
4,927,325 A * 5/1990 Yano ..... F01D 17/165 415/161
5,165,849 A 11/1992 Nakagawa et al.
5,516,263 A * 5/1996 Nishida ..... F04D 29/444 415/208.2
5,730,580 A * 3/1998 Japikse ..... F01D 17/16 415/208.1
6,607,353 B2 * 8/2003 Masutani ..... F04D 29/462 415/161
2003/0143084 A1 7/2003 Repple et al.
2005/0207885 A1 9/2005 Daudel et al.
2007/0022979 A1 2/2007 Gradu et al.
2008/0317609 A1 12/2008 Schmidt et al.
2009/0301412 A1 12/2009 Genster
2011/0188987 A1 8/2011 Schmidt et al.

FOREIGN PATENT DOCUMENTS

CN 101233338 A 7/2008
CN 101351631 A 1/2009
DE 29 21 583 A1 12/1980
DE 197 09 484 A1 9/1998
DE 10 2008 027 157 A1 12/2009
FR 2 153 796 A5 5/1973
GB 206825 A 1/1924

(Continued)

*Primary Examiner* — Igor Kershteyn
(74) *Attorney, Agent, or Firm* — Norman B. Thot

(57) ABSTRACT

A mechanical coolant pump for an internal combustion engine includes a pump rotor wheel comprising rotor blades configured to pump a coolant radially outward. A non-rotating ring of pump stator blades is configured to encircle the pump rotor wheel. At least one of the pump stator blades is a static blade. At least one of the pump stator blades is a pivotable blade configured to pivot about a pivot axis arranged within the pivotable blade.

15 Claims, 2 Drawing Sheets

(56) References Cited

FOREIGN PATENT DOCUMENTS

| | | | |
|---|---|---|---|
| JP | 44-3627 | | 2/1969 |
| JP | 3-63797 | U | 6/1991 |
| JP | 2006-512524 | A | 4/2006 |
| WO | WO 2009/138058 | A1 | 11/2009 |

* cited by examiner

MECHANICAL COOLANT PUMP

CROSS REFERENCE TO PRIOR APPLICATIONS

This application is a U.S. National Phase application under 35 U.S.C. §371 of International Application No. PCT/EP2011/054566, filed on Mar. 24, 2011. The International Application was published in English on Sep. 27, 2012 as WO 2012/126530 A1 under PCT Article 21(2).

FIELD

The present invention relates to a mechanical coolant pump for an internal combustion engine.

BACKGROUND

Mechanical coolant pumps are described in DE 10 2008 027 157 A1. These pumps comprise a pump rotor wheel driven by the engine and a static blade holding ring with numerous pivotable pump stator blades. The cool is fully controllable so that the coolant flow in the coolant circuit of a combustion engine can be adapted to the engine's need. The control of such a pump is realized by actuation of all pivotable pump stator blades, which is typically performed mechanically or electronically. The actuation of all pump stator blades requires a high actuation power, however, due to the high hydraulic and mechanical forces which act on each blade. As a result, the actuator which must be able to provide the maximum actuation power must be relatively large and energy consuming.

SUMMARY

An aspect of the present invention is to provide a mechanical coolant pump with a minimized actuator so that the pump can be designed as small as possible.

In an embodiment, the present invention provides a mechanical coolant pump for an internal combustion engine which includes a pump rotor wheel comprising rotor blades configured to pump a coolant radially outward. A non-rotating ring of pump stator blades is configured to encircle the pump rotor wheel. At least one of the pump stator blades is a static blade. At least one of the pump stator blades is a pivotable blade configured to pivot about a pivot axis arranged within the pivotable blade.

BRIEF DESCRIPTION OF THE DRAWINGS

The present invention is described in greater detail below on the basis of embodiments and of the drawings in which.

DETAILED DESCRIPTION

Figure 1:
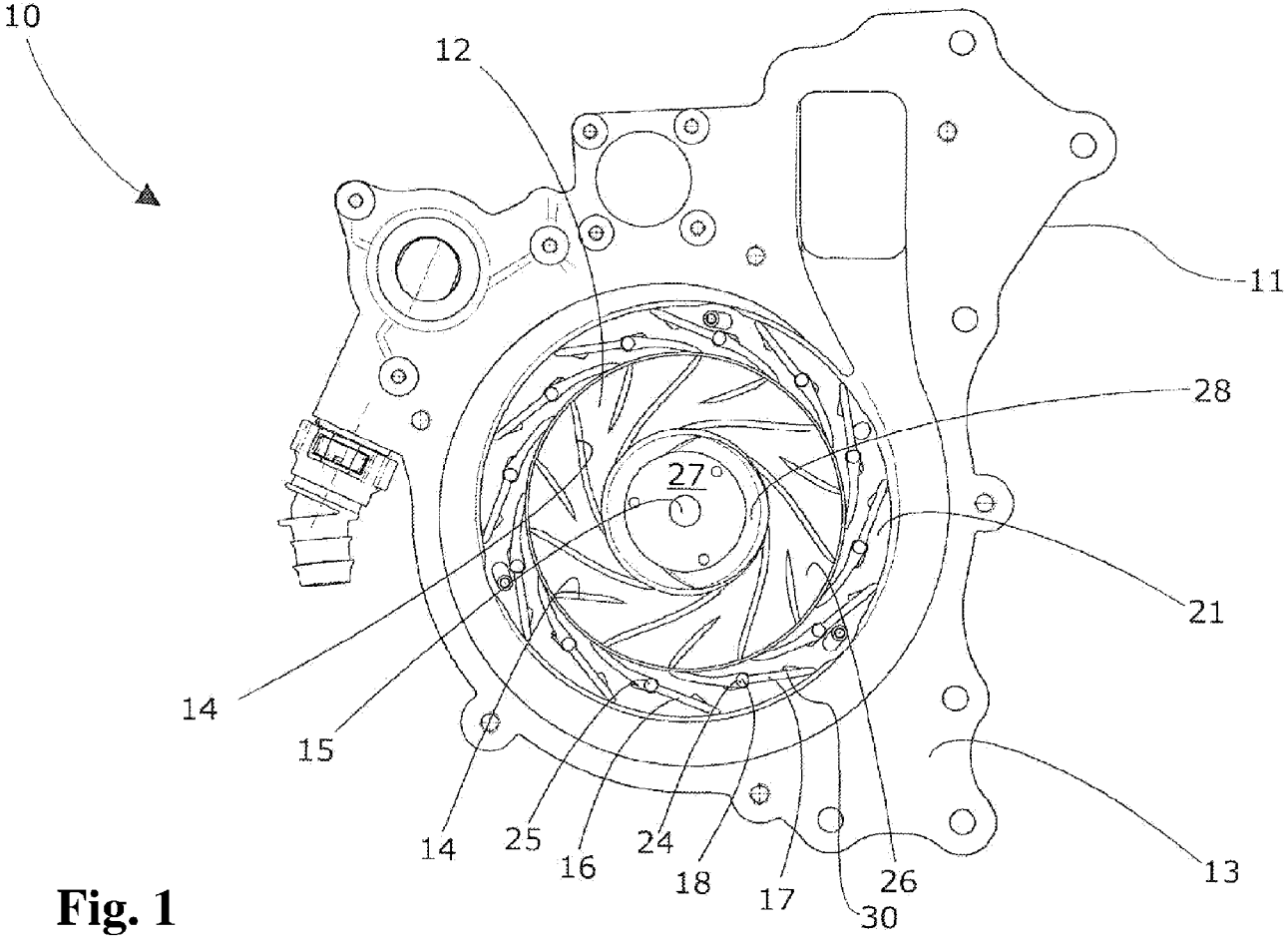
FIG. 1 shows a top view of a mechanical coolant pump with the pivotable pump stator blades in the open position.

The mechanical coolant pump for an internal combustion engine comprises a rotatable pump rotor wheel with rotor blades and with a central axial inlet opening. The pump rotor wheel is mounted on an axial shaft and is pumping the coolant radially outward. A non-rotating ring of pump stator blades encircles the circumference of the pump rotor wheel. The non-rotating ring of pump stator blades is formed by static blades which are totally fixed in a defined position, and by pivotable blades, whereby the pivotable blades are pivotable around a pivot axis arranged within the pivotable blades. The pivotable pump stator blades can be positioned in at least three different positions, i.e., the open position, the closing position, and an intermediate position.

An arrangement of pump stator blades formed by non-controllable static blades and by controllable pivotable blades reduces the actuation power of the pump stator blades almost in proportion to the reduced number of pivotable blades. As a result, the actuation power for controlling the pump stator blades decreases so that the size of the actuator can be minimized. The pump nevertheless remains fully controllable, and can be completely opened or completely closed.

In an embodiment of the present invention, the static blades and the pivotable blades are arranged alternately. An alternating arrangement of the static and pivotable pump stator blades leaves the mechanical coolant pump fully controllable and reduces the actuation power almost by 50%, because only half of the pump stator blades must be actuated by the actuator.

In an embodiment of the present invention, the static blades and the pivotable blades can, for example, be identical in shape. An identical shape of all pump stator blades keeps the manufacturing costs of the mechanical coolant pump low because both the pivotable and the static pump stator blades can be manufactured by the same production process. The assembly of a pump with pump stator blades of identical shape is furthermore less complex. Alternatively, the static blades and the pivotable blades can be different in shape.

In an embodiment of the present invention, the position of the static blades can, for example, be identical to the open position of the pivotable blades. This position of the static pump stator blades causes an optimal fluidic behavior so that the flow of the coolant, which is pumped radially outward by the pump rotor wheel, is not disturbed.

In an embodiment of the present invention, the pivot axis of the pivotable blades can, for example, be in the circumferential middle-third of the pivotable blades. The fluidic forces generate a considerable torque at both blade end parts. A positioning of the pivot axis in the circumferential middle-third of the pivotable blades can provide an equilibrium of the torques so that relatively low actuation forces are sufficient to open or close the pivotable blades.

In an embodiment of the present invention, the static blades and the pivotable blades overlap each other in part with their circumferential ends in the closing position. Although only every second of the pump stator blades is pivotable, the pump can be completely opened and closed so that the pump is fully controllable and the coolant flow can be adapted to the engine's need with the benefit of a decreased energy consumption.

In an embodiment of the present invention, a static blade holding ring can, for example, be provided with axial openings for receiving the pivot shafts of the pivotable blades and the fixing shafts of the static blades. The fixing shaft holds the static blades totally fixed, i.e. non-pivotable, in the open position. An axial opening is an uncomplex technique to provide a bearing which is simple to realize and therefore cost-efficient.

In an embodiment of the present invention, the pivotable blades can, for example, overlap and touch the adjacent static blades gap-free when the pivotable blades are in a closed position. The pivotable blades are stopped and/or supported by the totally fixed static blades in the closed position.

The overlapping pump stator blades can alternatively form a minimal gap between them in the closing position. In the closing position of the pump stator blades, the minimal gap allows a leakage of less than ten percent of the pumping volume in the open position.

FIG. 1 shows a mechanical coolant pump 10 for pumping the coolant for an internal combustion engine. The mechanical coolant pump 10 comprises a main pump body 11 supporting a blade control ring 21, a static blade holding ring (not shown) holding pump stator blades 16, 17 and a pump rotor wheel 12.

The static blade holding ring (not shown) is arranged between the main pump body 11 and the blade control ring 21. The static blade holding ring (not shown) can be an integrated part of the main pump body 11. The main pump body 11 is formed as a fluid-tight housing. The main pump body 11 is provided with a mounting flange 13 so that the main pump body 11 can be mounted directly to the engine block with the flange 13 or can have a cover body mounted to the flange 13.

A rotatable pump rotor wheel 12, which is mounted on an axial shaft 15, is provided with numerous rotor blades 14 which are positioned between a circular inlet ring 26 with a central inlet opening 27 and a circular back plate 28.

Radially outward of the pump rotor wheel 12, numerous pump stator blades 16, 17 arranged as a blade ring are supported by the static blade holding ring (not shown). Some of the pump stator blades 16, 17 are static blades 16 which are totally fixed, the remaining pump stator blades 16, 17 are pivotable blades 17 being pivotable around a pivot axis 18 which is arranged in the circumferential middle-third of the pivotable blades 17. The arrangement of the static and variable pump stator blades 16, 17 is alternating so that the number of static and pivotable blades 16, 17 is equal.

Both the static and the pivotable pump stator blades 16, 17 are identical in shape. Alternatively, the static and the pivotable pump stator blades 16, 17 can be different in shape. The pump stator blades 16, 17 have a slight bend, whereby the bending radius of the pump stator blades 16, 17 is close or similar to the outer radius of the pump rotor wheel 12.

The static blade holding ring (not shown) is provided with numerous axial openings (not shown) for receiving the pivot shafts 24 of the pivotable pump stator blades 17 and the fixing shafts 25 of the static blades 16. The pivotable pump stator blades 17 are controlled by the blade control ring 21 which is circumferentially rotatably arranged between the static blade holding ring (not shown) and the pump stator blades 16, 17.

The blade control ring 21 is provided with axial actuation openings 30. The axial actuation openings 30 for actuating the pivotable blades 17 have a longitudinal form which is not orientated in the circumferential direction of the blade control ring 21 but is arranged in an angle of 15°-45° with respect to the circumference. An actuation pin (not shown) of the pivotable pump stator blades 17 is respectively guided the actuation opening so that the pivotable pump stator blades 17 are pivoted when the blade control ring 21 is rotated.

The static blades are held permanently, i.e., totally fixed, in the open position by the fixing shafts 25 of the static blades 16, even if the blade control ring is rotated. Alternatively or additionally, the blade control ring 21 can be provided with axial guiding openings (not shown). The axial guiding openings (not shown) for the static blades 16 can be provided with a longitudinal form, which is oriented in the circumferential direction of the blade control ring 21 so that an actuation pin (not shown) of the static blades 16 holds the static blades 16 permanently in the open position, even if the blade control ring 21 is rotated.

Figure 2:
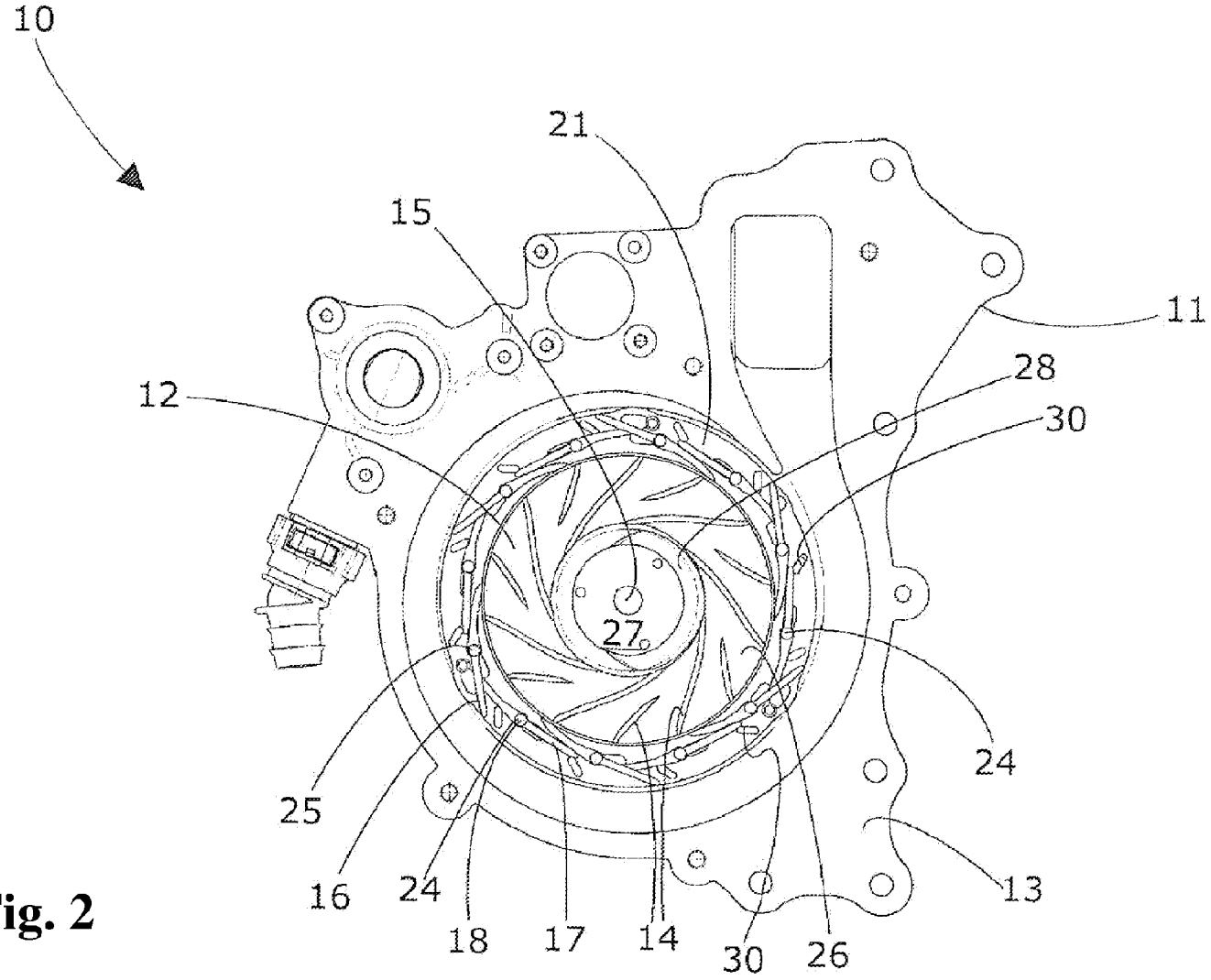
FIG. 2 shows a top view the mechanical coolant pump with the pivotable pump stator blades in the closed position.

The position of the static pump stator blades 16 is identical to the open position of the pivotable blades 17 as shown in FIG. 1. The circumferential ends of the static blades 16 and the pivotable blades 17 overlap and touch each other gap-free in the closing position as shown in FIG. 2.

The blade control ring 21 is actuated by an actuator which is not shown, so that the blade control ring 21 can rotate when the actuator is active.

The present invention is not limited to embodiments described herein; reference should be had to the appended claims.

What is claimed is:

1. A mechanical coolant pump for an internal combustion engine, the mechanical coolant pump comprising:

a pump rotor wheel comprising rotor blades configured to pump a coolant radially outward; and a non-rotating ring of pump stator blades configured to encircle the pump rotor wheel, the non-rotating ring of pump stator blades comprising static blades and pivotable blades, each of the pivotable blades comprising a pivot axis which is arranged within a respective pivotable blade, wherein, the static blades and the pivotable blades have an identical shape, and the pivotable blades are configured to overlap the static blades gap-free when the pivotable blades are in a closed position.

2. The mechanical coolant pump as recited in claim 1, wherein the static blades and the pivotable blades are arranged alternately.

3. The mechanical coolant pump as recited in claim 1, wherein a position of the static blades is identical to an open position of the pivotable blade.

4. The mechanical coolant pump as recited in claim 1, wherein the pivot axis of each respective pivotable blade is disposed in a circumferential middle-third of each respective pivotable blades.

5. The mechanical coolant pump as recited in claim 1, wherein the static blades and the pivotable blades are configured to overlap each other in a closed position.

6. The mechanical coolant pump as recited in claim 5, wherein the pivotable blades are configured to overlap the static blades gap-free when the pivotable blades are in the closed position.

7. The mechanical coolant pump as recited in claim 1, further comprising:

a static blade holding ring comprising axial openings, wherein, each of the pivotable blades comprises a pivot shaft, each of the static blades comprises a fixing shaft, and the axial openings are configured to receive the pivot shafts of the pivotable blades and the fixing shafts of the static blades.

8. A mechanical coolant pump for an internal combustion engine, the mechanical coolant pump comprising:

a pump rotor wheel comprising rotor blades configured to pump a coolant radially outward; and a non-rotating ring of pump stator blades configured to encircle the pump rotor wheel, the non-rotating ring of pump stator blades comprising static blades and pivotable blades, each of the pivotable blades comprising a pivot axis which is arranged within a respective pivotable blade, wherein, a position of the static blades is identical to an open position of the pivotable blades.

9. The mechanical coolant pump as recited in claim 8, wherein the static blades and the pivotable blades are arranged alternately.

10. The mechanical coolant pump as recited in claim 8, wherein the static blades and the pivotable blades have an identical shape.

11. The mechanical coolant pump as recited in claim 10, wherein the pivotable blades are configured to overlap the static blades gap-free when the pivotable blades are in a closed position.

12. The mechanical coolant pump as recited in claim 8, wherein the pivot axis of each respective pivotable blade is disposed in a circumferential middle-third of each respective pivotable blade.

13. The mechanical coolant pump as recited in claim 8, wherein the static blades and the pivotable blades are configured to overlap each other in a closed position.

14. The mechanical coolant pump as recited in claim 13, wherein the pivotable blades are configured to overlap the static blades gap-free when the pivotable blades are in the closed position.

15. The mechanical coolant pump as recited in claim 8, further comprising:

a static blade holding ring comprising axial openings, wherein, each of the pivotable blades comprises a pivot shaft, each of the static blades comprises a fixing shaft, and the axial openings are configured to receive the pivot shafts of the pivotable blades and the fixing shafts of the static blades.

* * * * *